US006205590B1

(12) United States Patent
Gorman

(10) Patent No.: US 6,205,590 B1
(45) Date of Patent: Mar. 27, 2001

(54) HEADBAND

(76) Inventor: Sonja Young Gorman, 31 Wellington, Bristol, TN (US) 37620

( * ) Notice: Subject to any disclaimer, the term of this patent is extended or adjusted under 35 U.S.C. 154(b) by 0 days.

(21) Appl. No.: 09/489,708

(22) Filed: Jan. 24, 2000

(51) Int. Cl.[7] ..... A41D 20/00
(52) U.S. Cl. ..... 2/181
(58) Field of Search ..... 2/181, 181.2, 181.4, 2/181.6, 181.8, 182.1, 183, 184, DIG. 11, 171, 209.3

(56) References Cited

U.S. PATENT DOCUMENTS

| | | | | |
|---|---|---|---|---|
| D. 363,404 | | 10/1995 | Cute . | |
| 1,697,919 | * | 1/1929 | Knepper | 2/171 |
| 2,223,332 | * | 11/1940 | Sterene | 2/171 |
| 4,394,782 | * | 7/1983 | Wasson | 2/181 |
| 4,502,156 | * | 3/1985 | Wishman | 2/181 |
| 4,503,560 | | 3/1985 | Bourne . | |
| 4,675,915 | * | 6/1987 | Siciliano | 2/181 |
| 4,723,325 | * | 2/1988 | Perry | 2/207 |
| 4,742,581 | * | 5/1988 | Rosenthal | 2/181 |
| 4,833,734 | * | 5/1989 | Der Estephanian | 2/171 |
| 4,856,116 | * | 8/1989 | Sullivan | 2/181 |
| 4,947,488 | | 8/1990 | Ashinoff . | |
| 5,033,122 | * | 7/1991 | Smith | 2/209 |
| 5,146,630 | * | 9/1992 | Richard | 2/181 |
| 5,305,470 | * | 4/1994 | McKay | 2/7 |
| 5,331,686 | | 7/1994 | Marshall . | |
| 5,377,360 | | 1/1995 | Fieitman . | |
| 5,423,091 | * | 6/1995 | Lange | 2/181 |
| 5,432,955 | | 7/1995 | Plotka . | |
| 5,546,603 | * | 8/1996 | Lawhorne et al. | 2/181 |
| 5,566,395 | | 10/1996 | Nebeker . | |
| 5,613,248 | | 3/1997 | Young . | |
| 5,632,046 | | 5/1997 | Green . | |
| 5,640,721 | * | 6/1997 | Jackson | 2/171 |
| 5,647,061 | * | 7/1997 | Marcus | 2/11 |
| 5,745,921 | | 5/1998 | Mitchell et al. . | |
| 5,826,277 | | 10/1998 | McConville . | |
| 5,887,284 | | 3/1999 | Simmons . | |
| 5,915,532 | * | 6/1999 | Williams | 2/171 |
| 5,963,989 | * | 10/1999 | Robertson | 2/411 |
| 6,029,272 | * | 2/2000 | Bazin | 2/12 |

* cited by examiner

*Primary Examiner*—John J. Calvert
*Assistant Examiner*—Alissa L Hoey
(74) *Attorney, Agent, or Firm*—Waddey & Patterson; I. C. Waddey, Jr.

(57) ABSTRACT

The present invention provides a headband that is constructed of a combination of elements. The interior portion of the headband is made of a terrycloth material which has a high absorption and wicking capacity. The terrycloth portion of the headband is fitted against the brow of the person wearing the headband. Layered directly adjacent the terrycloth is a pad of chamois which has the ability to absorb large quantities of moisture. A good chamois can generally absorb two to three times its weight in moisture and thus is a highly efficient material for use in the headband product of the present invention. A backing of support cloth fits behind the chamois and extends beyond the terrycloth pad to form tie ribbons so that the headband can be tied about the forehead of the person using the invention. By the construction of elements as set forth above, the headband is capable of absorbing many times over its weight in moisture, thus allowing a person wearing the headband to engage in strenuous aerobic exercise and activity, generating large amounts of perspiration, all of which will be absorbed into the headband to keep the perspiration from running onto the face and into the eyes of the person wearing the headband.

8 Claims, 2 Drawing Sheets

HEADBAND

BACKGROUND OF THE INVENTION

The present invention relates generally to exercise accessory equipment and particularly to headbands for use by persons engaged in aerobic activities.

The benefits of regular strenuous aerobic activities have been well documented. What once was considered the "fitness craze" is now a way of life for a majority of individuals in both the United States and abroad. Running, basketball, jazzercise, and the like are but a few of the aerobic activities in which individuals regularly engage in order to establish and maintain a healthy lifestyle.

A byproduct of strenuous aerobic exercise is that a good workout would generate significant perspiration.

It is well known that the region of maximum heat transfer of the human body is the head and scalp and when a person is exercising, the perspiration that is formed in the head and scalp area will condense into droplets of perspiration. These droplets of perspiration will tend to run down over the face and into the eyes of the person exercising, thus causing irritation to the eyes and blurring vision. Both of these byproducts of the exercise routine can be annoying and when one is engaging in ball such as basketball, it can be dangerous to have blurred vision. To remedy this byproduct of strenuous aerobic exercise, many people wear headbands or sweatbands about their forehead to try to soak up the perspiration and keeping it from running onto the face and into the eyes. Prior art headbands and sweatbands, while effective to some degree, have proven to be deficient in other areas. Specifically, in the past, in order to get a headband that is sufficiently absorbent to hold a significant amount of perspiration generated during the course of an exercise routine headbands have been required to be so large and cumbersome that they in some manners interfere with the exercise routine. Smaller, thinner headbands which are better suited to and more compatible with the exercise routine do not have sufficient absorption capacity to soak up all the perspiration that is generated during a vigorous workout. The present invention overcomes these deficiencies of the prior art.

SUMMARY OF THE INVENTION

The present invention provides a headband that is constructed of a combination of elements. The interior portion of the headband is made of a terrycloth material which has a high absorption and wicking capacity. The terrycloth portion of the headband is fitted against the brow of the person wearing the headband. Layered directly adjacent the terrycloth is a pad of chamois which has the ability to absorb large quantities of moisture. A good chamois can generally absorb two to three times its weight in moisture and thus is a highly efficient material for use in the headband product of the present invention. A backing of support cloth fits behind the chamois and extends beyond the terrycloth pad to form tie ribbons so that the headband can be tied about the forehead of the person using the invention. By the construction of elements as set forth above, the headband is capable of absorbing many times over its weight in moisture, thus allowing a person wearing the headband to engage in strenuous aerobic exercise and activity, generating large amounts of perspiration, all of which will be absorbed into the headband to keep the perspiration from running onto the face and into the eyes of the person wearing the headband.

Having briefly described the invention, it will be understood that it is an object of the present invention to provide a lightweight thin headband having a high absorption capacity. It is another object of the invention to provide a lightweight highly flexible headband with a relatively high moisture absorption capacity. It is still a further object of the invention to provide a headband having a terrycloth facing, an intermediate layer of chamois, and a backing of cloth. It is a further object of the present invention to provide a multi-layer headband including layers of terrycloth, chamois, and cloth with the cloth backing extending beyond the terrycloth and chamois layers to form tie ribbons so that the headband can be tied about the forehead of the user.

Having described generally the present invention and its objectives, the full scope of the present invention will be appreciated by those skilled in the art upon a review of the following detailed description of the preferred embodiment of the invention which is made in conjunction with the attached drawings. In the following description of the preferred embodiment of the invention, like numerals refer to like elements of the invention.

DESCRIPTION OF THE PREFERRED EMBODIMENTS

Figure 1:
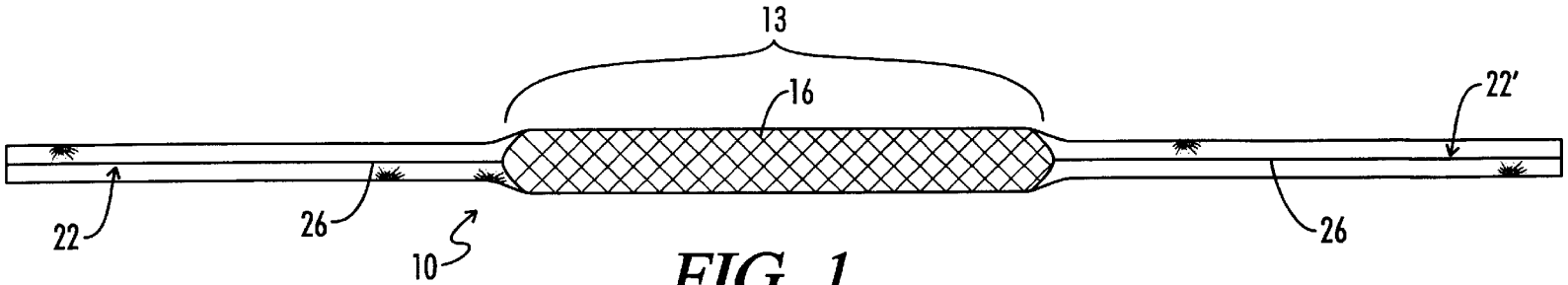
FIG. 1 shows a frontal view of the headband of the present invention.
Figure 2:
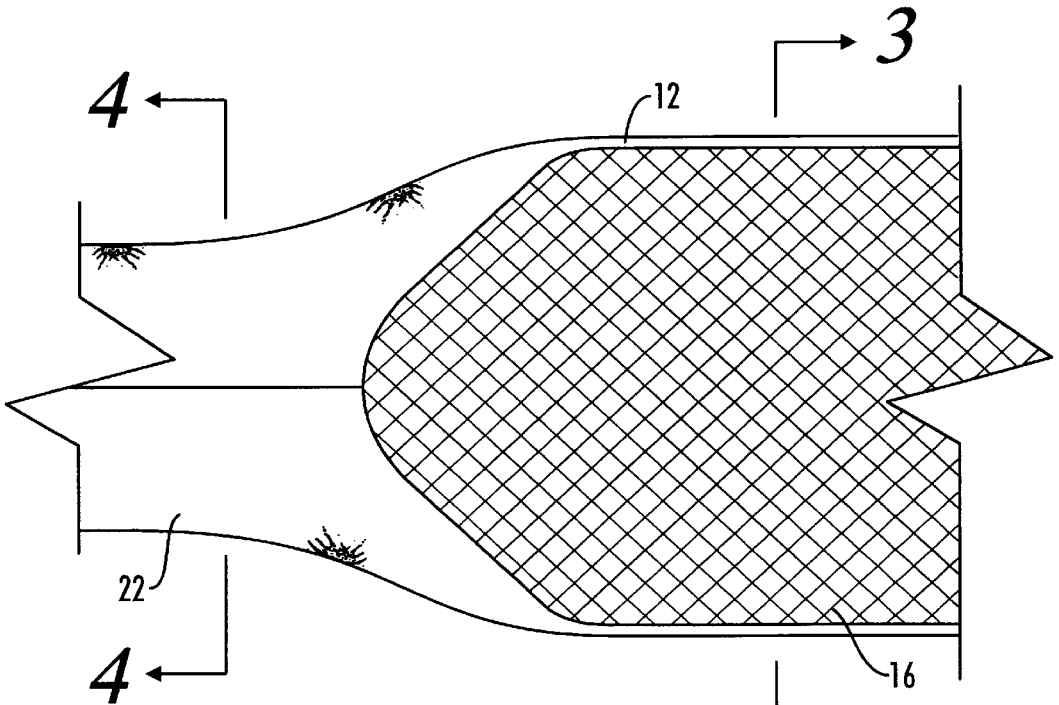
FIG. 2 shows a blown-up portion of a section of the headband of the present invention.
Figure 4:
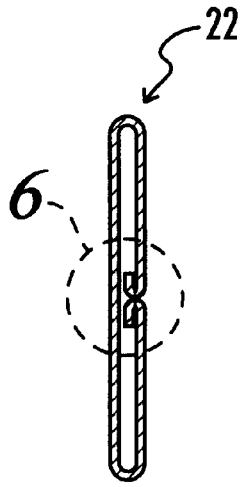
FIG. 4 shows a cross section of the headband of the present invention taken along the lines 4—4 of FIG. 2.
Figure 3:
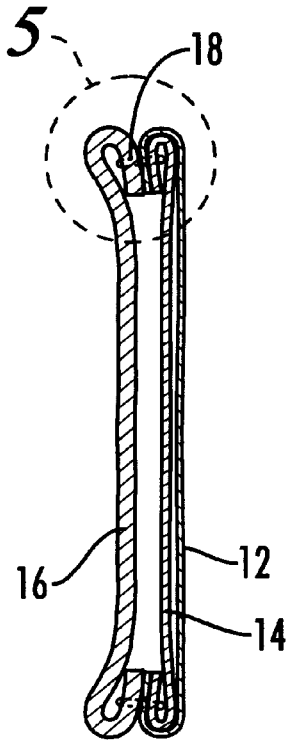
FIG. 3 shows a cross section of the present invention taken along the lines 3—3 of FIG. 2.
Figure 6:
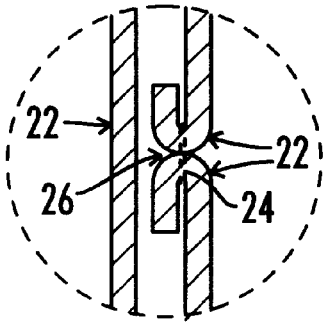
FIG. 6 is a blown-up section of the center section of the tie ribbon of the headband taken at approximately the point to which the arrow attached to the blown-up portion is directed.
Figure 5:
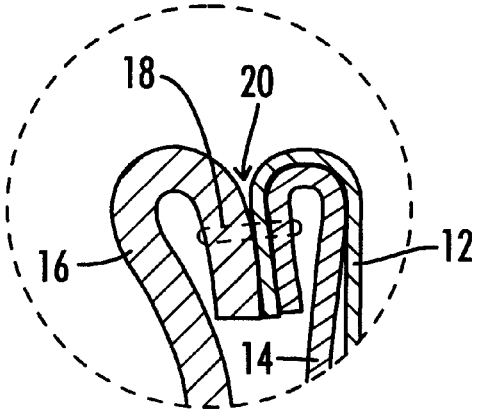
FIG. 5 is a blown-up section of the end of the headband of the present invention taken along the end in which the arrow attached to the blown-up section is pointing.

FIGS. 1 and 2 illustrate generally the headband 10 which is constructed of a support cloth 12 that serves as a backing for the headband and extends from a center section in opposing directions to form tie ribbons 22 and 22'. The center section 13 is faced with a layer of terrycloth 16. The center section also includes an elongated band of chamois 14 sandwiched between the terrycloth 16 and the support cloth 12. The outside perimeter of the bands of chamois, terrycloth, and support cloth are folded in on each other as is illustrated best in FIG. 5, to form a seam 20 which is held together by stitching 18. The stitching 18 constitutes binding means to hold the bands of chamois, terrycloth, and support cloth together. Other binding means can include stitching, adhesives, tacking, braiding, and other forms of securing the three bands of material together. Extending from the center section 13 of the headband are the tie ribbons 22 and 22' which are formed by folding the ends of the support cloth 12 over onto themselves and forming a second seam 26 which is held in place by a second stitching 24. The second stitching 24 allows the narrower tie ribbons to be formed so that the headband can be tied about the forehead of the user using the tie ribbons 22, 22'. The tie ribbons 22, 22' can be formed integrally with a section of elastic material stitched into the tie ribbons so that the headband could be held about the forehead of the user through the elastic contraction of the elastic material. Alternatively, the bands can simply be tied about the forehead of the user to cause the headband to fit about the user's head.

In the preferred embodiment, the support cloth and tie ribbons are made of the same material and that material is a cotton/polyester blend.

In the preferred embodiment of the invention as described above, when the invention is in use, it is dry and placed about the forehead of the user and the tie ribbons are tied to securely hold the headband in place. As the user engages in aerobic exercise and perspiration is generated, the perspiration about the forehead and on the head of the user will soak into the terrycloth layer of the material which is placed directly against the skin of the user. The terrycloth layer of material will absorb a substantial amount of moisture and the wicking characteristics of the terrycloth material will also cause the perspiration to move through the layer of terrycloth material. As the perspiration moves through the layer of terrycloth material, the chamois which is pressed against the outside surface of the terrycloth material will wick the water away from the terrycloth material and absorb the moisture into the chamois. The chamois will absorb moisture in multiples of its own weight and the perspiration absorbed by the layers of terrycloth and chamois will generally prevent any moisture from falling into the eyes of the user even during the most strenuous exercise. The backing layer of support cloth 12 holds the headband securely against the user's head and this material is not particularly wicking and will not tend to absorb the moisture from the chamois and therefore the moisture will not condense on the outside of the headband or run from that point down into the face and eyes of the user.

Prior art devices simply are not as efficient as the structure of the present invention. Specifically, prior art devices that have used foam-type material to absorb the perspiration will not hold a sufficient amount of perspiration to achieve the same degree of efficiency of the present invention. Further such devices are thick and cumbersome to bind about the head of the user, will make the person using such devices appear to have a "helmet" on their head as opposed to a simple headband, and are not nearly as desirable in both appearance and efficiency. Other prior art devices have used terrycloth as an absorption material for headbands, but once again, such devices are ineffective because they will not hold a sufficient amount of moisture to last through a full strenuous workout. Thus, the present invention has overcome the deficiencies of the prior art and constitutes a new and useful improvement that would not be obvious to one of ordinary skill in the art.

Although there have been described particular embodiments of the present invention of a new and useful Headbands, it is not intended that such references be construed as limitations upon the scope of this invention except as set forth in the following claims.

What is claimed is:

1. A headband to be worn about the head of a user engaged in aerobic activities including:

a. an elongated band of chamois;

b. a band of support cloth backing said band of chamois;

c. a band of terrycloth facing said chamois;

d. means binding said bands of chamois, support cloth and terrycloth together; and e. means for securing said bound bands about the head of a user of the headband when the headband is in use whereby said headband absorbs perspiration generated as a result of the aerobic activities of the user to keep such perspiration from running into the eyes and face of the user.

2. The headband of claim 1 wherein the band of support cloth covers substantially the entire chamois and extends beyond the chamois to form the securing means.

3. The headband of claim 1 wherein the band of support cloth and the securing means are made of the same material.

4. The headband of claim 1 wherein the band of support cloth forms a loop to encircle the head of the user when the headband is in use.

5. The headband of claim 1 wherein the band of support cloth extends from the chamois to form at least two tie ribbons.

6. The headband of claim 5 wherein the tie ribbons each are elongated and have opposing ends, one end of each being integral with said band of support cloth and the other end of each being free.

7. The headband of claim 1 wherein the shape of the headband is a loop to encircle the head of a user with the terrycloth on the inside of the loop, the support cloth on the outside of the loop, and the chamois sandwiched between the terrycloth and the support cloth.

8. The headband of claim 1 wherein the band of support cloth is made of a cotton/polyester blend of material.

* * * * *